United States Patent [19]

Petrelli et al.

[11] Patent Number: 4,752,362

[45] Date of Patent: Jun. 21, 1988

[54] DETECTING AND ESTIMATING SHORTING PHENOMENA IN HALL CELLS AND CONTROL OF CELL ANODES IN RESPONSE THERETO

[75] Inventors: Vincent A. Petrelli, Penn Hills; Charles L. Dobbs, Washington Township, Armstrong County; Wayne W. Hyland; Allen J. Sharkins, both of Lower Burrell; Marwan Simaan, Churchill, all of Pa.; Harold A. Savage, Maryville; Alan A. Ciukowski, Friendsville, both of Tenn.

[73] Assignee: Aluminum Company of America, Pittsburgh, Pa.

[21] Appl. No.: 7,329

[22] Filed: Jan. 27, 1987

[51] Int. Cl.[4] ..... C25C 3/06

[52] U.S. Cl. ..... 204/67; 204/1 T; 340/650

[58] Field of Search ..... 204/1 T, 67; 340/650

[56] References Cited

U.S. PATENT DOCUMENTS

| | | | |
|---|---|---|---|
| 3,812,024 | 5/1974 | Goodnow et al. | 204/67 |
| 3,875,030 | 4/1975 | Richards et al. | 204/67 |
| 4,431,491 | 2/1984 | Bonny et al. | 204/67 |

OTHER PUBLICATIONS

Hyland, W. W., "The Current Efficiency of a Shorted Anode in a Prebake Cell", *Light Metals* 1984, pp. 711–720.

*Primary Examiner*—John F. Niebling
*Assistant Examiner*—Kathryn Rubino
*Attorney, Agent, or Firm*—Elroy Strickland

[57] ABSTRACT

A method of controlling interelectrode distance when a short occurs between an anode and the cathode metal pad of an electrolytic cell. Anode current data is provided by sampling anode current at a relatively high frequency, and noting any substantial instantaneous increase in current by observing the data over a period of time. Estimates of instantaneous losses in current efficiency over a base period of time due to the shorting are then made. Current efficiency losses are reduced by repositioning the anode via a command from a cell control computer to anode positioning means or by manual adjustment of the anodes in the cell.

5 Claims, 4 Drawing Sheets

DETECTING AND ESTIMATING SHORTING PHENOMENA IN HALL CELLS AND CONTROL OF CELL ANODES IN RESPONSE THERETO

BACKGROUND OF THE INVENTION

The present invention relates to a method of detecting conditions in a cell for smelting aluminum which, if not corrected, would result in a significant decrease in the Faradaic current efficiency of the cell. More particularly, the invention is directed to a method for detecting intermittent shorting between an anode and a cathodic metal pad. The invention includes anode positioning to eliminate such shorting on an individual anode basis and thus returns the process to a condition of improved current efficiency.

In the operation of a cell reducing aluminum from alumina, Faradaic current efficiency is affected or reduced by a number of well-known factors; one of these factors is electrical short-circuiting or grounding of carbon anodes to the cathodic metal pad of the cell. The terms "short" and "shorting" are defined as increases in anode current that are greater than a predetermined value of amperes per second, and greater than normal average anode current by a predetermined amount. Shorting most often occurs when an anode is improperly positioned in the cell and low frequency undulation and roll of the metal pad caused by the magnetic field of electrical buses that carry current to and from the cell is present. Various methods for controlling the position of the anodes are used in the industry and are discussed in detail in the following U.S. Patents.

U.S. Pat. No. 3,812,024 to W. H. Goodnow et al provides a good summary of cell control. A baseline cell resistance is established where deviations ($\Delta R$) are determined in a smoothed fashion via periodic sampling of cell voltage and line amperes. This provides a periodically calculated cell resistance. Due to normal cell fluctuations in anode current, a noise term is developed which is used to feed alumina to the cell in a manner that reduces cell resistance when in the correct operating region of an alumina concentration-resistance curve of the cell.

U.S. Pat. No. 4,431,491 to P. Bonney et al also concerns control of resistance deviations in smelting cells using baseline resistance and variation of the alumina feed. In this instance the noted deviation of resistance ($\Delta R$) forces an anode control mechanism to reposition the anodes in a corrective manner until the amount of correction in a given direction exceeds a preset amount and the feed schedule is modified.

Neither of the above methods is concerned with relatively high frequency sampling of resistance or anode current fluctuations which occur over the daily life of the cell. High frequency is in terms of a rate of sampling individually the currents of the many anodes found in industrial aluminum smelting cells and pot lines. Resistance deviations ($\Delta R$) caused by intermittent shorting confuse the effort to control resistance, i.e., the confusion causes error in the rate of alumina feed or occurrence of anode bridge positioning, which are two methods of controlling cell resistance.

U.S. Pat. No. 3,875,030 to N. E. Richards et al provides for the detection of shorted or grounded anodes wherein it is disclosed that the rate of anode bubble formation is a function of useful current through the anode, the electrolyte, and cathode system. A shorted or grounded anode produces gas at a less frequent rate and exhibits a frequency spectrum which can be related to the proportion of shorting current passing directly from the anode to the cathode metal as electronic conduction. Such conduction does not reduce aluminum metal from the alumina ore.

Apparatus for monitoring selected anode currents via multiplexing is also disclosed in the Richards et al patent. The apparatus determines the amount of shorting over a period of time by filtering and pulse counting. The number of pulses counted after filtering can be related to the useful anode current when compared to the actual average anode current. An anode that is shorting can carry any magnitude of current but the shorting anode will have a reduced number of pulses counted with respect to an anode operating at full efficiency at an equal current.

The case of continuous shorting, as opposed to intermittent shorting, is examined by Wayne W. Hyland, one of the present inventors, in an article entitled "The Current Efficiency of a Shorted Anode in a Prebake Cell", published in *Light Metals* 1984 by the Metallurgical Society of the American Institute of Metallurgical Engineering. By using a mathematical model of a cylindrical anode, the article shows that the current efficiency of an anode undergoing a continuous short will have a decreased cathodic metal current efficiency that is a function of the current through the anode and circuit of the short. The size of the shorting geometry determines the cathodic current efficiency and the total anode current for a given anode voltage.

Summary of the Invention

The present invention is based on the discovery that medium and large instantaneously occurring shorts or contacts of an anode with cathodic metal can best be detected and estimated by sampling anode current data at a relatively high frequency. Small shorts may not be discernable in the normal anode current measurement since the magnitude of anode current noise would be similar to the normal change occurring in anode/electrolyte resistance caused by bubble production and escape. A steep rise in instantaneous anode current is the onset of the occurrence of a short. Such current has been found to rise to some maximum which is based upon the cross section of the short, anode voltage, the size of the anode and the relationship of the other anodes in the cell. A short results in an instantaneous loss in current efficiency since a portion of the current flowing through the anode directly to the cathode bypasses the electrolyte such that no metal is produced at the cathode metal pad interface. The magnitude of instantaneous loss of current efficiency is approximated by a constant multiplied by the area that is bounded by total ampere seconds from the time the short is detected minus the average value of current noted prior to detection of the short over the same period of time. The constant that is applied is a function of anode size. The total loss in current efficiency is obtained over a period of time by summation of each shorting occurrence measured, where the base period may be hours or days. Since these sums are continually increasing functions for each anode in the cell, it has been found that resetting the summations to zero at the beginning of a new base period is desirable.

An objective of the present invention, therefore, is to detect and move a shorting anode in an aluminum producing electrolytic cell. This is achieved by measuring a fluctuating voltage lengthwise of an anode rod or an anode current shunt that is proportional to the current flowing through the anode. This fluctuating voltage is filtered to eliminate frequencies outside the range of frequencies attributed to the growth and release of resistive gas bubbles on the bottom surface of the anode and is sampled at least five times a second to prevent aliasing, as explained below.

Another objective of the invention is to provide an improved method for detecting a shorting anode by estimating Faradaic losses in a cell due to the direct passage of current from the bottom surface of the anode to the cathodic metal. The method involves calculating a derivative $\Delta i/\Delta t$ of the sampled anode current signal, where changes in anode current greater than a predetermined value of amperes per second, as discussed earlier, is defined as a short. The charge (current flow in amperes over a period of time in seconds) lost as a result of shorting for a time T is divided by the total charge passed through the anode for time T.

The loss in current efficiency of the anode due to shorting is calculated by the following equation:

$$\text{Percent Shorting Loss} = 100 \times \frac{Q_{short}}{Q_{total}} \quad (1)$$

where:

$Q_{short}$ = the integrated area of shorting anode current for time T, and $Q_{total}$ = the total current passed through the anode for time T.

The end of a shorting period is detected if the sum of $\Delta i/\Delta t = 0$, if a short is detected longer than a maximum limit, or if $\Delta i/\Delta t$ is sufficiently negative (i.e., a sharp drop in anode current).

Yet another objective of the invention involves directing a computer controlling a cell to move an anode conducting a predetermined amount of shorting current for a given period of time. Movement of the anode can be effected by the anode positioning systems associated with cells that have individual or multiple supported anodes. Or, for those cells that are of the fixed bridge or gang type, the computer can annunciate or provide an alarm for a workman to raise the anode manually.

A further objective of the invention is to provide an algorithm for automatically performing the steps of the above method on the computer.

DESCRIPTION OF A PREFERRED EMBODIMENT

During the electrochemical reduction of alumina in a Hall cell, carbon anodes of the cell are consumed in a process that produces primarily carbon dioxide and molten aluminum, with the aluminum being deposited on the cathode of the cell in the form of a metal pad. The carbon dioxide is released as bubbles from the lower surfaces of the anodes.

For a given electrolyte composition and hydrostatic pressure (dependent on the amount of anode immersion) in the electrolyte, the bubbles grow until they overcome the hydrostatic pressure and move from underneath the surface of the anode and toward the atmosphere at the upper surface of the electrolyte and cell. The mass volume of bubble gas is proportional to the rate of production of aluminum metal or anode current density on the lower surface of the anode. The growth and release of bubbles causes increases and decreases in the contact area between the electrolyte and the anode; hence, current flow through each anode fluctuates between a maxima and a minima at a rate dependent upon the rate of gas evolution or bubble production at the anode and the relation of that anode to the other cell anodes. These changes in anode current due to the release of gas at the bottom surface of the anode may only be measured by sampling the anode current signal at a rate fast enough to prevent aliasing of the signal, i.e., when the sampling frequency is less than twice the highest frequency in the signal, the higher frequencies of the cyclic phenomenon are reflected into the lower frequencies and thus take on the identity of the lower frequencies. This phenomenon is call "aliasing". Aliasing is avoided in the present invention by sampling a fluctuating voltage across an anode rod or voltage shunt that is proportional to the current flowing through the anode at least five times a second (5 Hz). This fluctuating voltage is filtered to eliminate frequencies above the range of frequencies attributed to shorting and the growth and release of the resistive gas bubbles, i.e., frequencies in excess of 2.5 Hz.

Figure 1:
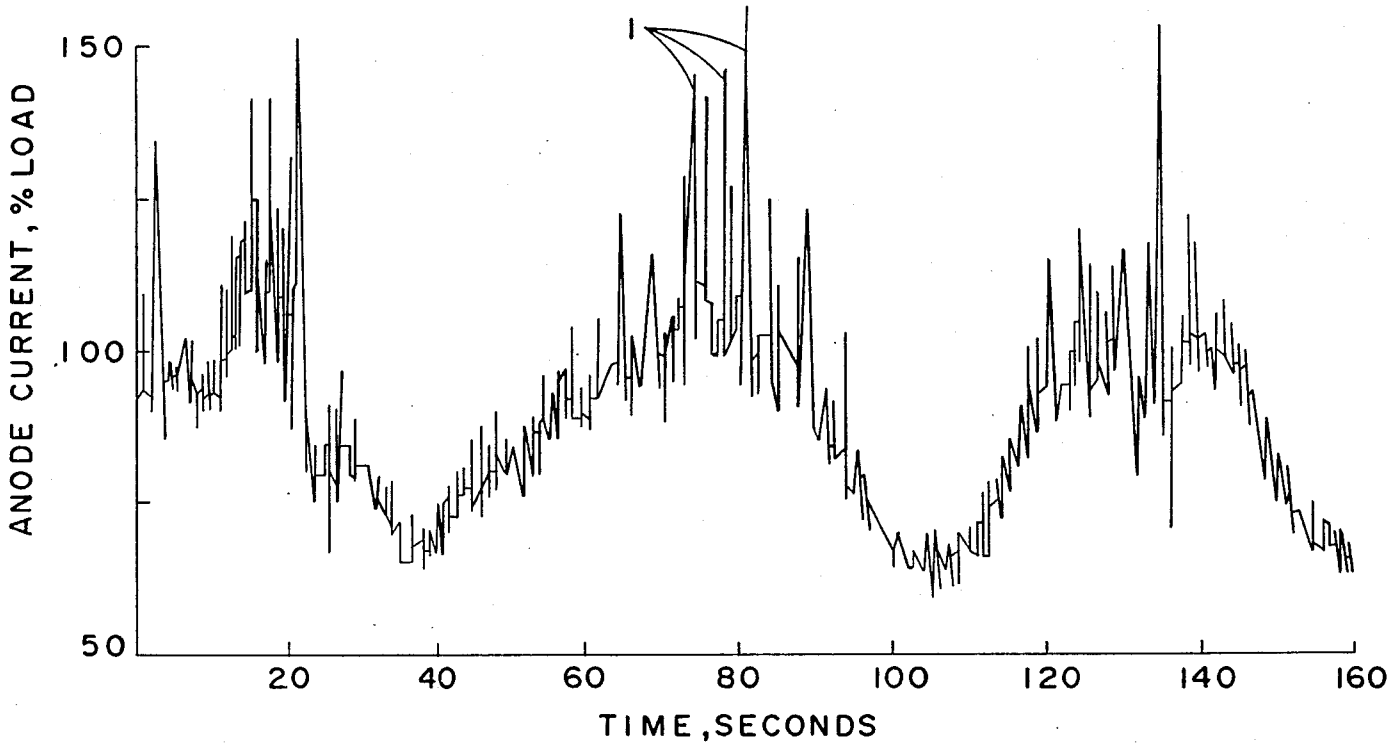
FIG. 1 is an example of an anode current signal that illustrates in graph form shorting of an anode with the metal pad of a cell.

To assist in explaining the invention, FIG. 1 graphically depicts anode current data for a typical shorting anode. (Current is plotted in terms of percent load on the abscissa of the graph of FIG. 1, 100% load being nominal anode current.) Shorting current is designated by numeral 1 and is characterized by rapid increases in current that represent the direct passage of current from the bottom surface of the anode to the metal pad on the cell cathode. The direct passage of current to the metal pad contributes nothing to the reduction process and therefore represents efficiency losses in the electrolytic cell. Massive shorting most often occurs when an anode is purposely lowered in the metal to kill an anode effect. Massive shorting can also occur when the metal pad rolls or undulates, as explained earlier. Another condition leading to a shorting anode is the uneven rate of consumption of the anode which results in a relative unbalance in its position in the cell.

Figure 2:
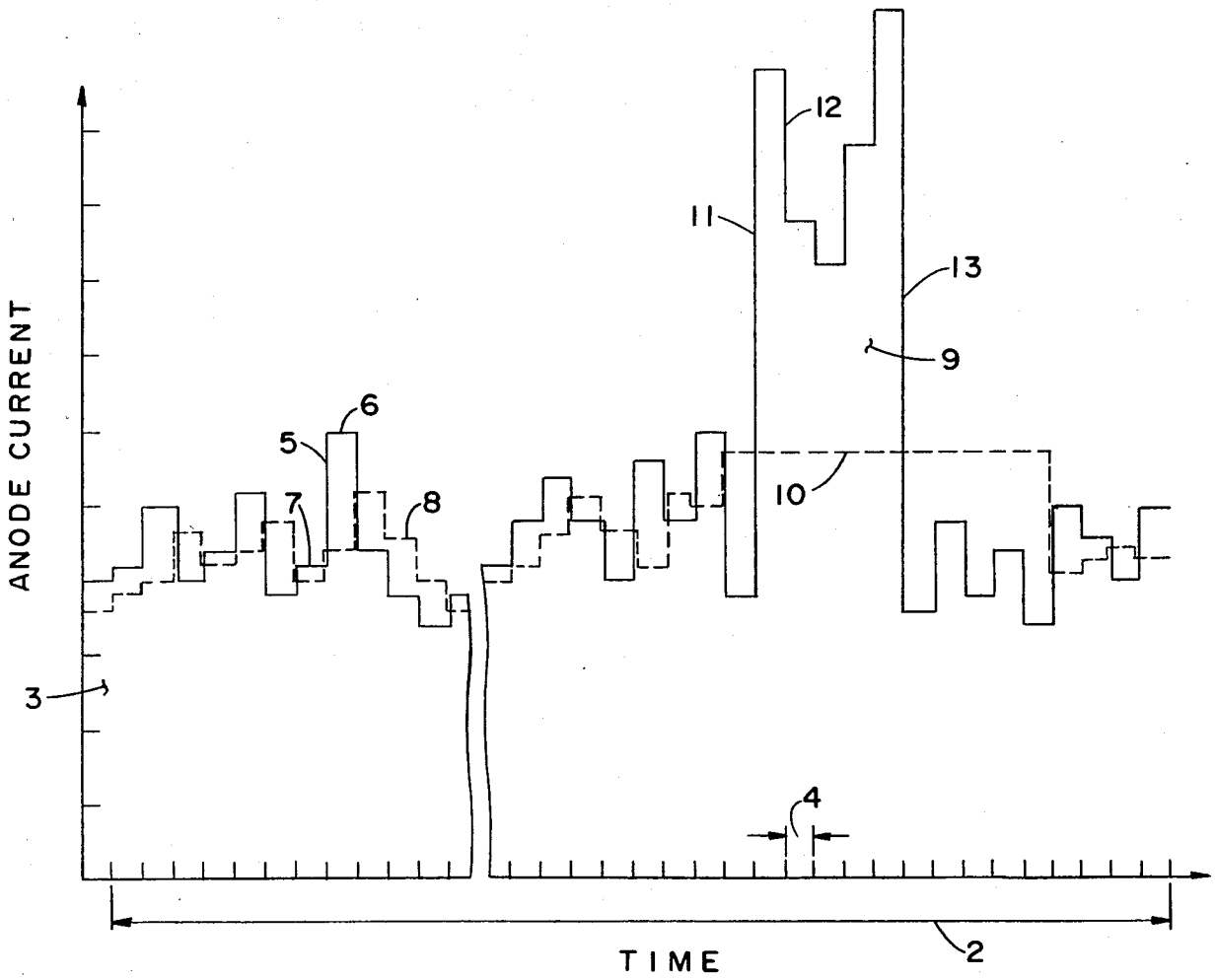
FIG. 2 illustrates in graph form a process of integrating the area under a curve representing a shorted anode and the integration of total current passed through the short for a given period of time.

At the beginning of a period of time T, which labelled 2 in FIG. 2 chosen to log process parameters of a cell, for example, functions that accumulate total anode current ampere seconds ($Q_{total}$), and shorting anode current ampere seconds ($Q_{short}$), are initialized to zero. (The zero location in FIG. 2 is the lower left-hand corner of the log.) At each sampling of anode current (designated by numeral 4 in FIG. 2), the total ampere seconds for the sample period is added to the prior value of ampere seconds from the previous sample period. Upon the detection of a short, an accumulator process is used to accumulate shorting ampere seconds ($Q_{short}$). At the end of the logging period 2, a percentage of lost current efficiency is calculated for each anode of a cell by dividing the amount of shorting ampere seconds ($Q_{short}$) by the total amount of ampere seconds passed through the anode ($Q_{total}$).

The graph and log of FIG. 2 illustrate the method of calculating the total Faradaic losses in the cell due to shorting. At each sample period 4 the method involves: (a) integrating the total current, as plotted on the abscissa of the graph, passed through the anode for a period of time T (plotted on the ordinate of the graph); (b) calculating a derivative $\Delta i/\Delta t$ of the sampled anode current; (c) determining if the change in anode current from the previously sampled value constitutes a short: (d) if the anode is shorting, integrating the area of the short above a baseline $I_{flt}$ where $I_{flt}$ is defined as a one-second filtered sample of anode current in a non-shorting segment 3 of the sampling; and (e) if the anode was not shorting for the last five consecutive scans, updates $I_{flt}$.

For a control period of time 3, i.e., the non-shorting segment in FIG. 2, the total anode current ampere seconds ($Q_{total}$) passed through the anode is integrated for each sample period 4, as expressed by the equation:

$$Q_{total} = \sum_{i=1}^{T} I_i \times t_{sample} \tag{2}$$

where:

$I_i$ are anode current samples taken in the period T, and $t_{sample}$ is the anode current sampling interval.

A derivative ($I_{derv}$) earlier referred to as $\Delta i/\Delta t$, of the sampled anode current, labeled 5 in FIG. 2, is calculated each sample period 4 as the difference between the samples $I_{(N)}$ at 6 and $I_{(N-1)}$ at 7 in FIG. 2. The derivative can be expressed:

$$I_{derv} = I_{(N)} - I_{(N-1)} \tag{3}$$

where:

$I_{(N)}$ is the new value 6 of sampled anode current, and $I_{N-1)}$ is the previous value of 7 of sampled anode current.

A short is detected if the change in anode current ($I_{derv}$) exceeds a predetermined threshold denoted as $I_{turn\text{-}on}$. The action of the $I_{derv}$ comparison acts as a filter to take out normal bubble-induced excursion of the anode current. In other words, normally, small fluctuations are not indicative of shorting.

If $I_{derv}$ is less than $I_{turn\text{-}on}$ no short is detected for this sample period. If no short is detected for at least five consecutive sample periods, a filtered value of $I_{flt}$ (labeled 8 and shown in dash outline in FIG. 2) for this sampling period is calculated as:

$$I_{flt(N)} = 0.20 \times I_{(N)} + 0.80 \times I_{flt(N-1)} \tag{4}$$

where:

$I_{flt(N)}$ is the new value of a filtered baseline current, and $I_{flt(N-1)}$ is the previous value of the filtered baseline current.

If $I_{derv}$ exceeds $I_{turn\text{-}on}$ a short is detected for this sample period, and the area 9 between $I_{(N)}$ and $I_{flt(N\text{-}1)}$ is integrated as $I_{impulse}$ and calculated as:

$$I_{impulse} = I_{(N)} - I_{flt(N-1)} \tag{5}$$

If a short is detected for this sample period, $I_{flt}$ is not updated, as indicated by numeral 10 in FIG. 2. Rather, the shorting current $I_{short}$ for the sample period is then calculated as:

$$I_{short} = (A_{size}) \times (I_{impulse}) \tag{6}$$

$I_{short}$ is limited such that:

$$I_{(N)} - I_{short} \geqq 0 \tag{7}$$

$A_{size}$ is a proportionality constant used to adjust the instantaneous loss of current efficiency based on the available surface area of the anode. For small shorts only a portion of the anode current is lost, but for very large shorts, it is appropriate to assume that all anode current is lost and no metal product is made during the shorting period. For industrial type anodes, $A_{size}$ may take on values between 1.5 and 2.5 depending on the size of the anode.

The magnitude of $I_{turn\text{-}on}$ is dependent on anode size; for small anodes carrying an average current of 3,000 amperes a rate of 1,700 amperes per second would be appropriate, for larger anodes carrying an average current of 7,000 amperes, an effective rate would be 4,000 amperes per second.

Upon the detection of a short, an accumulator for lost ampere seconds $Q_{short}$ is used to accumulate shorting ampere seconds and is updated as follows:

$$Q_{short} = \sum_{i=1}^{T} I_{shorti} \times t_{sample} \tag{8}$$

where:

$I_{short}$ is the integrated area of the short detected for this sample period, and $t_{sample}$ is the sampling interval.

At the onset of short detection, the accumulator ($I_{sum}$) is activated which constantly adds the difference between the $I_{(N)}$ and $I(_{N-1})$ anode current samples in units of amperes. As the short progresses, the $I_{sum}$ value grows in a positive manner if $I_{(N)} > I_{(N-1)}$, at 11 in FIG. 2, and decreases if $I_{(N)} < I_{(N-1)}$, at 12, as follows:

$$I_{sum(N)} = I_{sum(n-1)} + I_{derv} \tag{9}$$

The detection of short completion is achieved if the value of the $I_{sum}$ accumulator is equal to or less than zero, at 13 in FIG. 2, $I_{derv}$ is sufficiently negative to indicate a massive drop in anode current or the short encountered is of a duration exceeding a time $T_{turn\text{-}off}$ that is defined as an impractical duration for a short. If the latter is true, the anode must have recovered from shorting at an average anode current that is greater in magnitude prior to the onset of shorting. This may occur due to (a) changes in metal pad topology which modifies the anode to cathode space, (b) the activity that takes place in the cell during anode effect, or (c) improper anode positioning.

At the conclusion of each logging period 2 of time T, the loss in current efficiency of each anode due to shorting is calculated as:

$$\text{Percent Shorting Loss}_{anode} = 100 \times \frac{Q_{shortanode}}{Q_{totalanode}} \tag{10}$$

A total loss in current efficiency for the cell during this period may then be constructed from the current efficiency loss observed for each individual anode, as calculated above. In addition, several periods may be defined for logging data to indicate the long term efficiency of a reduction cell.

Figure 3:
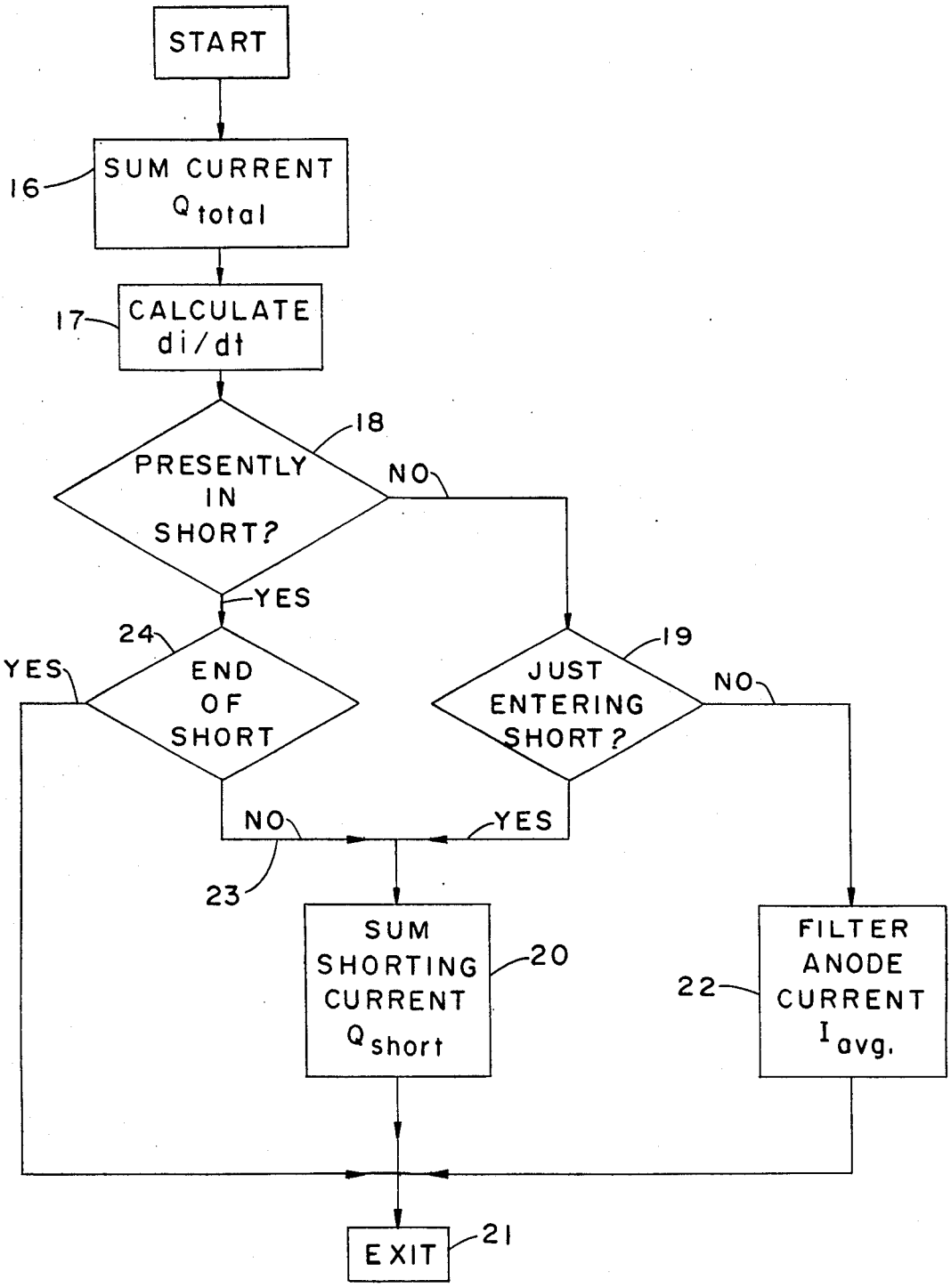
FIG. 3 is a flow chart of the algorithm of the invention for detecting and quantifying the short of an anode.

FIG. 3 illustrates the method described above by use of a flowchart of an algorithm for detecting shorts. The total current passed through an anode for sample periods 4 is summed at 16 as $Q_{total}$ (equation 2), a derivative $\Delta i/\Delta t$ ($I_{derv}$) of the sampled anode current is calculated at 17, and a check 18 is made to determine if the anode was shorting during the last sample period.

If the anode was not in a shorting condition during the last sample period, a flag word is checked at 19 to determine if a new short is being detected. If the anode is just entering a short, the total ampere seconds for shorting anode current $Q_{short}$ is summed at 20 and an exit from the algorithm occurs at 21. If the anode was not shorting for this sample period and for at least the last five consecutive sample periods, average current $I_{flt}$ is updated at 22 and then an exit is made from the algorithm.

If the anode was shorting the last sample period and continues in a shorting condition for this sample period such that decision block 24 gives a "no" answer at 23, total ampere seconds for shorting anode current $Q_{short}$ is summed at 20 again, and an exit is made at 21.

If the anode was shorting during the last sample period but has met the criteria for end of short for this sample period, such that the answer is "yes" at 24, an exit is made (again) at 21.

Figure 4:
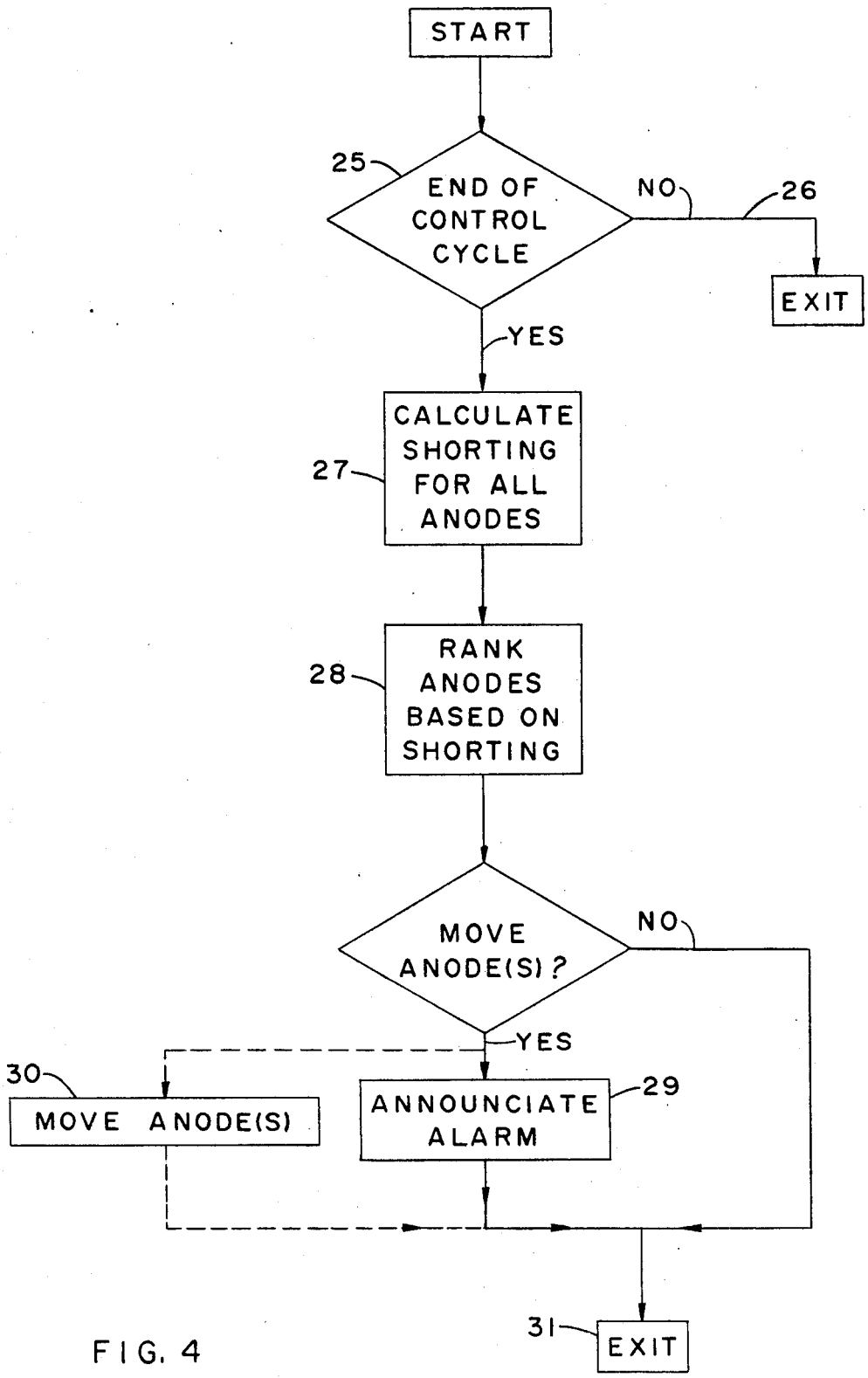
FIG. 4 is a flow chart of the anode position annunciator and anode position control algorithm of the invention.

FIG. 4 illustrates a control algorithm for calculating the current efficiency loss for each anode in the cell and for repositioning the anode(s) in response thereto. Repositioning can be automatic or manual. If manual, the algorithm makes a verbal announcement or provides an alarm for a workman attending the cell.

The control algorithm runs immediately following the shorting algorithm of FIG. 3 at the end of each control period 3. The algorithm process is as follows:

A check is made at 25 to determine the end of a control period 3 (FIG. 2). If the end of the period has not been reached during this sample period, an exit is made from the algorithm at 26.

If the end of a control period 3 has been reached during the sample period, current efficiency loss is calculated for each anode in the cell at 27. Then, all anodes are ranked at 28 according to the amount of current efficiency loss noted in the previous control period 3. For those anode(s) that exceeded a predetermined amount of shorting in the last control period, an alarm or annunciation is made at 29 for operating personnel to manually reposition the anode(s), and/or to signal at 30 the cell's anode positioning system to automatically raise the anode(s). An exit is then made at 31 from the algorithm.

While the invention has been described in terms of preferred embodiments, the claims appended hereto are intended to encompass all embodiments which fall within the spirit of the invention.

What is claimed is:

1. A method of controlling interseclectrode distance when a short circuit occurs between an anode and the cathode metal pad of an aluminum producing electrolytic cell, comprising providing anode current data by sampling the flow of electrical current through the anode at a rate sufficient to ensure against aliasing, noting any substantial instantaneous increase in the amoung of current flow by observing the data over a period of time, the current flow being determined by sampling voltage fluctuations across an anode rod or shunt that are proportional to the amount of instantaneous current flowing through the anode, filtering the sampled voltage fluctuations via band limit rejection of all fluctuation below a specifiable limit to eliminate from consideration those frequencies caused by the normal growth and release of gas bubbles forming on the lower surfaces of the anode, calculating a digital derivative $\Delta i/\Delta t$ of the sampled current when a change in anode current is defined as a short because it exceeds a predetermined ampere per second value and is above the frequency of the specifiable limit, calculating the loss in current efficiency in the cell because of the shorting anode by solving the equation $$\text{Percent Shorting Loss} = 100\,\frac{Q_{short}}{Q_{total}}\ \%$$

where:

$Q_{short}$ is the total ampere seconds of shorting anode current, and $Q_{total}$ is the total amount of current conducted through the shorting anode for the shorting period, such that through cancellation, percent shorting loss equals Fabadaic losses due to shorting, and increasing the distance between the anode and cathode when current efficiency loss exceeds a predetermined value.

2. The method of claim 1 including the step of providing an announcement or alarm for operating personnel to manually raise an anode or anodes in those cells that are of the fixed bridge or gang type when current effieciency loss due to shorting exceeds a predetermined value.

3. The method of claim 1 including the step of directing a computer to move an anode or anodes in those types of cells having individual or paired anode positioners when current efficiency loss due to anode shorting exceeds a predetermined value.

4. The method of claim 1 in which Faradaic losses are calculated by detecting the onset of a short between the anode and metal pad, determining the total amount of current flow through the anode over the duration of the short, determining the completion of the duration of the short, and at the conclusion of the duration, calculating the loss in current efficiency for the anode.

5. The method of claim 4 in which the calculation of current efficiency loss is effected by initially setting to zero the total amount of anode ampere seconds and shorting ampere seconds at the beginning of a base period of time, sampling electrode current for a sample period of time, at each sampling occurrence add the prior value of ampere seconds to the value of ampere seconds of the latest sample period, upon the occurrence of a short, accumulating lost ampere seconds, and at the end of the base period, calculate the percentage of lost current efficiency by dividing the amount of the accumulated lost ampere seconds by the total amount of ampere seconds conducted through the anode during the base period.

* * * * *